US009162129B2

(12) United States Patent
Horvath

(10) Patent No.: US 9,162,129 B2
(45) Date of Patent: Oct. 20, 2015

(54) TACTICAL TRAINING AIDS

(71) Applicant: Dwayne A. Horvath, Pittstown, NJ (US)

(72) Inventor: Dwayne A. Horvath, Pittstown, NJ (US)

( * ) Notice: Subject to any disclaimer, the term of this patent is extended or adjusted under 35 U.S.C. 154(b) by 119 days.

(21) Appl. No.: 13/861,601

(22) Filed: Apr. 12, 2013

(65) Prior Publication Data

US 2013/0273503 A1 Oct. 17, 2013

Related U.S. Application Data

(60) Provisional application No. 61/625,464, filed on Apr. 17, 2012.

(51) Int. Cl.

| | |
|---|---|
| ***A63B 69/00*** | (2006.01) |
| ***F41B 13/08*** | (2006.01) |
| ***F41A 33/00*** | (2006.01) |
| *A63B 24/00* | (2006.01) |
| *A63B 71/06* | (2006.01) |

(52) U.S. Cl.

CPC ..... *A63B 69/00* (2013.01); *A63B 69/004* (2013.01); *F41A 33/00* (2013.01); *F41B 13/08* (2013.01); *A63B 24/00* (2013.01); *A63B 2069/0044* (2013.01); *A63B 2071/0625* (2013.01); *A63B 2207/02* (2013.01); *A63B 2220/20* (2013.01); *A63B 2220/24* (2013.01); *A63B 2220/801* (2013.01); *A63B 2225/50* (2013.01)

(58) Field of Classification Search

CPC ..... A63B 69/00; A63B 69/004; A63B 2069/0044; A63H 33/009

USPC ..... 434/11; 463/47.2

See application file for complete search history.

(56) References Cited

U.S. PATENT DOCUMENTS

| | | | |
|---|---|---|---|
| 2,206,697 | A | 7/1940 | Harter |
| 2,294,026 | A | 8/1942 | Tuscan |
| 2,885,779 | A | 5/1959 | Newkirk |
| 2,998,974 | A | 9/1961 | Stafford |
| 3,755,893 | A | 9/1973 | Nagaki |
| 4,254,951 | A | 3/1981 | De Lany |
| 4,328,966 | A | 5/1982 | Miyamoto |
| 4,329,866 | A | 5/1982 | Babbitt |
| 4,364,104 | A | 12/1982 | Holahan et al. |
| 4,382,166 | A | 5/1983 | Kim |
| 4,383,386 | A | 5/1983 | Giordano et al. |
| 4,558,609 | A | 12/1985 | Kim |
| 4,678,450 | A | 7/1987 | Scolari et al. |
| 4,690,404 | A | 9/1987 | Yoder |
| 4,772,028 | A | 9/1988 | Rockhold et al. |
| 4,892,303 | A | 1/1990 | Lohre |
| 4,904,222 | A | 2/1990 | Gastgeb et al. |
| 5,060,379 | A | 10/1991 | Neely |
| 5,174,756 | A | 12/1992 | Taylor |
| 5,288,274 | A | 2/1994 | Bell et al. |
| 5,402,575 | A | 4/1995 | Maxcy |
| 5,836,670 | A | 11/1998 | Gilson |

(Continued)

*Primary Examiner* — Timothy A Musselman

(74) *Attorney, Agent, or Firm* — Kolisch Hartwell, PC

(57) ABSTRACT

Contact-indicating devices including an elongate contacting member, and a housing configured to enclose a portion of the contacting member, the housing further enclosing a translation sensor configured to detect an inward longitudinal translation of the contacting member, and a rotation sensor configured to detect a pivoting of the contacting member in a first direction. The disclosed devices further include at least one indicating element, where the indicating element is configured to differentiate between the detected longitudinal translation of the contacting member and the detected pivoting of the contacting member in the first direction.

25 Claims, 10 Drawing Sheets

(56) References Cited

U.S. PATENT DOCUMENTS

| | | | | |
|---|---|---|---|---|
| 6,036,576 | A | 3/2000 | Colon, Jr. | |
| 6,293,684 | B1 | 9/2001 | Riblett | |
| 6,352,465 | B1 | 3/2002 | Heymann et al. | |
| 6,434,829 | B1 | 8/2002 | Chen | |
| 6,497,619 | B2 | 12/2002 | Dowdy et al. | |
| 6,561,809 | B1 | 5/2003 | Lynch et al. | |
| 6,945,842 | B1 | 9/2005 | Gulmesoff | |
| 7,033,242 | B2 | 4/2006 | Gulmesoff | |
| 7,353,984 | B2 | 4/2008 | Quail | |
| 7,833,130 | B1 * | 11/2010 | Horvath | 482/12 |
| 2003/0138761 | A1 * | 7/2003 | Pesnell et al. | 434/247 |
| 2006/0099560 | A1 * | 5/2006 | Gregorio et al. | 434/272 |

* cited by examiner

TACTICAL TRAINING AIDS

CROSS-REFERENCE TO RELATED APPLICATIONS

This application claims the benefit under 35 U.S.C. §119 (e) of provisional application Ser. No. 61/625,464 for TACTICAL TRAINING AIDS, filed Apr. 17, 2012, the disclosure of which is herein incorporated by reference for all purposes.

TECHNICAL FIELD

The invention relates to tactical training aids in the form of contact-indicating apparatus. More particularly, the invention relates to contact-indicating apparatus that simulate bladed weapons for training or recreational purposes, in the form of hand-held knives for hand-to-hand combat.

BACKGROUND

Tactical training, such as may be carried out by martial artists, law enforcement personnel, and military personnel, often includes training in hand-to-hand combat techniques, including knife fighting. In order to practice such techniques safely, non-edged practice knives are often used in place of an actual edged weapon. Such practice knives may be made of wood, rubber, or aluminum, among other materials.

Such training is more effective when the instructor and student can immediately observe when a successful contact is made during sparring. One way to provide feedback involves the use of marking devices that leave a mark or stain when touching a target. However, these marking devices often mark undesired surfaces, such as practice mats, hands, and the user's clothing. The marking devices may also need to be refilled, or have their colored coating periodically reapplied. Further, when not in use, a sheath or cover is required in order to prevent additional undesired marks from being made.

Such marking devices also fail to convey any information to the users other than an indication that contact has been made, providing little feedback as to a user's technique. What is needed is a training aid that can differentiate between contacts made using a tip of the practice blade and contacts made using an edge of the practice blade. In this way, an instructor or student can be provided with immediate feedback relating to the user's technique, so that the quality of the instruction is improved.

SUMMARY

The invention includes contact-indicating devices, the devices including an elongate contacting member; a housing configured to enclose a portion of the contacting member, a translation sensor configured to detect an inward longitudinal translation of the contacting member, and a rotation sensor configured to detect a pivoting of the contacting member in a first direction. The disclosed devices further include an indicating element configured to differentiate between a longitudinal translation of the contacting member and a pivoting of the contacting member.

In another aspect of the invention, the disclosed contact-indicating devices are useful in methods for indicating contact with a target, where the methods include providing a contact-indicating device, making contact with a target with the contacting member, where the contact is substantial enough to cause either a translation of the contacting member or a pivoting of the contacting member, or both, such that the corresponding translation sensor, rotation sensor, or both are triggered. The contact-indicating apparatus is configured to differentiate between the triggering of the translation sensor and the triggering of the rotation sensor when indicating the contact.

The invention further includes tactical training aids, where the training aids include a blade having a tip, an edge, and a tang; and a housing enclosing the tang and forming a blade handle. The housing also encloses a sensor configured to detect a longitudinal translation of the tang caused by substantial contact with the blade tip, and a sensor configured to detect a rotation of the tang with respect to a pivot point for the blade within the housing, where the rotation is caused by substantial contact with the blade edge. The tactical training aid is configured to differentiate between, and indicate the detection of, substantial contact with the blade tip and substantial contact with the blade edge.

In yet another aspect of the invention, the disclosed tactical training aids are useful for a method of tactical training which includes providing a tactical training aid, effecting contact with a target using the blade of the tactical training aid, where the contact is sufficient to activate the longitudinal translation sensor, activate the rotation sensor, or activate both sensors; observing an indication of substantial contact by the tactical training aid; and identifying whether the effected contact occurred with the blade tip, the blade edge, or both.

DETAILED DESCRIPTION OF PREFERRED EMBODIMENTS

Figure 1:
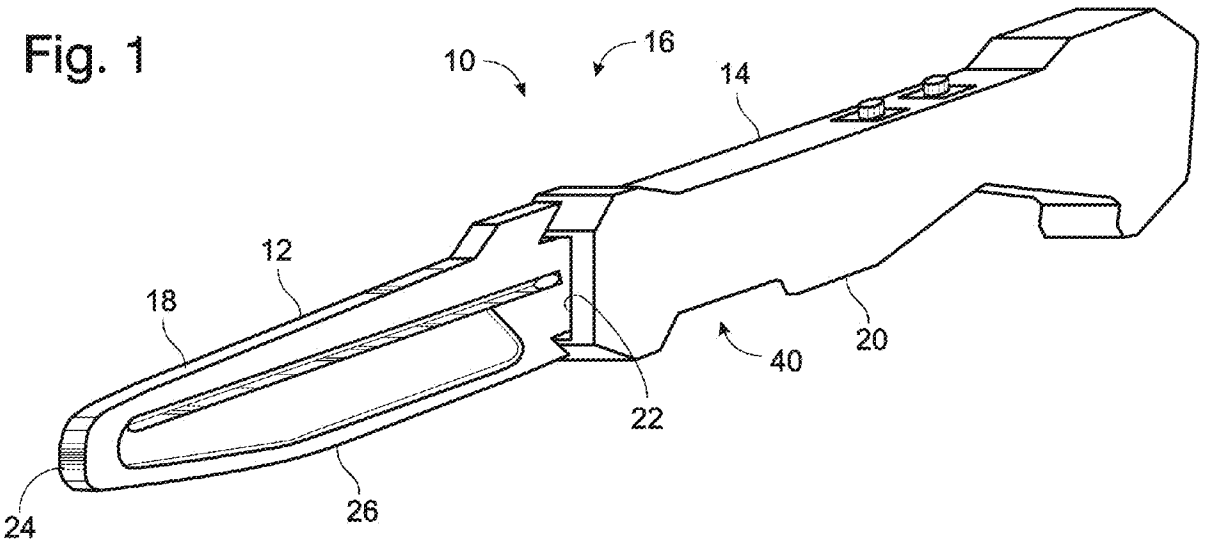
FIG. 1 is a depiction of a training aid according to an exemplary embodiment of the present invention.

FIG. 1 illustrates an exemplary contact-indicating device 10. The contact-indicating device 10 includes an elongate contacting member 12, and a housing 14 that encloses a portion of the contacting member 12. Typically, housing 14 also functions as a handle for the contact-indicating device 10.

In one aspect of the invention, the contact-indicating device 10 is a tactical training aid 16, and therefore may be configured to resemble a bladed weapon in one or more aspects. For example, as illustrated in FIGS. 1-5 the exemplary contact-indicating device resembles a knife, with the portion of the elongate contacting member 12 extending from the housing 14 having a form and appearance resembling a blade 18, while housing 14 acts as a handle 20 for blade 18. FIGS. 1-5 depict the exemplary training aid 16 in semi-schematic form, where some aspects of the device are shown schematically.

As shown in FIGS. 2-5, blade 18 extends from and beyond housing 14 by way of a slot or aperture 22 in the housing. Although not intended to be either pointed or sharp, blade 18 is adapted to resemble a knife blade and typically includes both a blade tip 24 and a blade edge 26. Blade tip 24 and blade edge 26 are typically blunt, and may even present a flat contact surface, so that the user of training aid 16 is free to employ the training aid realistically and without fear of causing an accidental injury. As discussed in greater detail below, training aid 16 may be adapted to distinguish between, and individually record, contacts made with the blade tip 24 and contacts made with the blade edge 26.

Blade 18 includes a tang portion 28 that is normally enclosed by housing 14. Although blade 18 is securely fastened within the housing 14, the construction of the tang and housing combine to permit blade 18 to move, but with only two degrees of freedom.

First, blade 18 may be compressed into housing 14, resulting in an inward longitudinal translation of the blade. This blade motion is typically caused by a substantial contact with the blade tip 24, such as may result when the training aid is used in a stabbing or thrusting motion. The longitudinal translation of blade 18 is resisted by a translational biasing element 30, which urges the blade 18 longitudinally outward from the housing 14.

Secondly, blade 18 may be rotated with respect to a pivot point 31 disposed just within housing 14. The blade rotation is typically caused by a substantial contact with the blade edge 26, such as may result when the training aid is used in a slashing motion. The rotation of blade 18, corresponding to a clockwise rotation as depicted in FIG. 2, is resisted by a rotational biasing element 32, which urges blade 18 in a contrariwise rotation.

Figure 2:
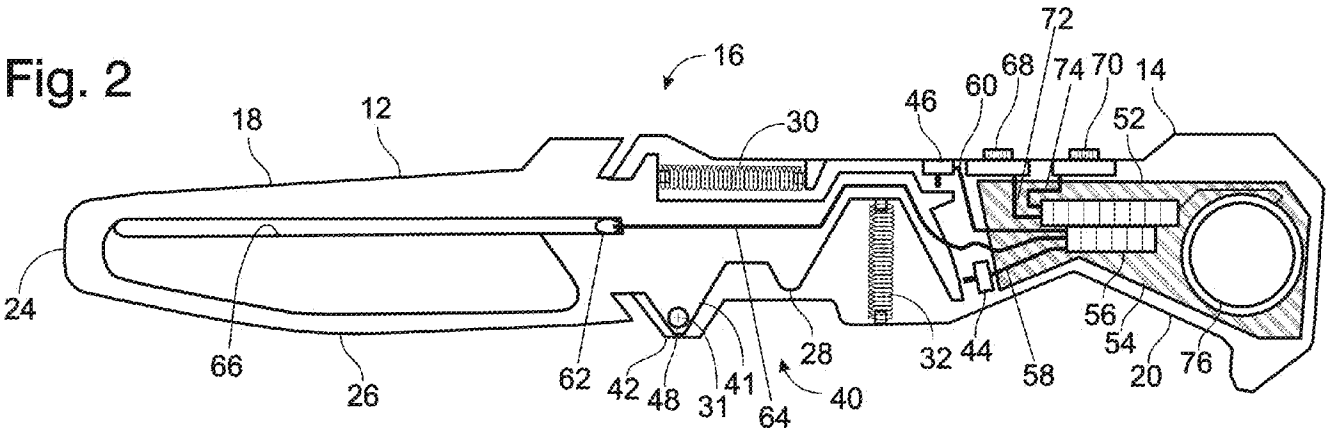
FIG. 2 is a cutaway side elevation view of the training aid of FIG. 1.
Figure 3:
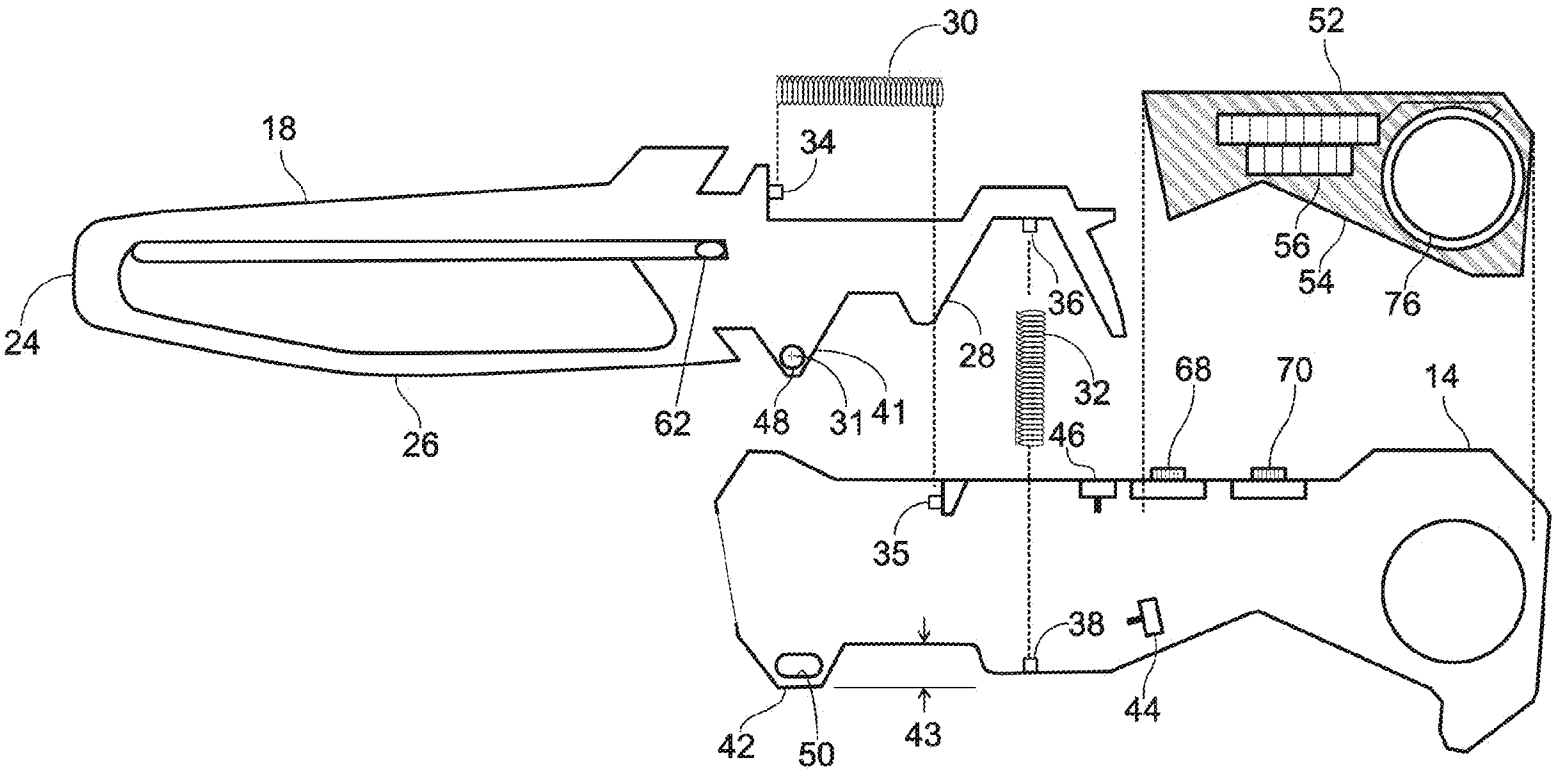
FIG. 3 is an exploded view of the training aid of FIG. 2.

Translational biasing element 30 and rotational biasing element 32 are depicted in FIGS. 2-3 as springs. Biasing element 30 is secured in place by a peg 34 on blade tang 28 in combination with a peg 35 formed within housing 14. Similarly, biasing element 32 is secured in place by a peg 36 on blade tang 28 and by a peg 38 within housing 14.

Housing 14 may incorporate a recessed region 40 on the underside of the housing, as shown in FIGS. 1 and 3, where the recessed region can confer several advantages to the training aids of the present invention. For example, recessed region 40 may provide an enhanced grip by virtue of being placed where a user's index finger may naturally fall.

Recessed region 40 may be adjacent to the pivot point 31 of blade 18. In one embodiment of the invention, pivot point 31 may be disposed on or near the tip of a tang extension 41, where tang extension 41 projects downwardly with respect to the depictions of FIGS. 1-5, and therefore requires a corresponding housing extension 42 in order to accommodate the tang extension.

By placing pivot point 31 further from the backbone of blade 18, the results of rotating blade 18 around the pivot point are enhanced, or made more readily detectable. That is, by lowering the pivot point, the movements of blade tang 28 are emphasized and therefore more easily detected.

Typically, tang extension 41 and housing extension 42 are disposed adjacent to recessed region 40, and the relative distance 43 between the greatest extension of pivot point 31 and the and the depth of recessed region 40.

Although the biasing elements of FIGS. 2 and 3 are depicted as compression springs, any mechanism that can apply a suitable biasing force to blade 18 is suitable for use in the training aids of the invention. For example, rather than using springs in a compressive mode, a bias may be applied to the blade using springs in an extensive mode (stretching rather than compressing). Alternatively, elastic straps or bands may be used to provide a stretching bias, or resilient bodies may be used to provide a compressive bias. Alternatively, or in addition, one or more leaf springs may be utilized, rather than coil springs, to apply the desired bias.

In one embodiment of the invention, the biasing elements of training aid 16 are adjustable. The translational biasing element 30 and the rotational biasing element 32 may be individual adjustable, or the biasing elements may be coupled in such a way that adjustment of the strength of one biasing element will affect the strength of the other biasing element. For example, increasing the resistance of the translational biasing element 30 may simultaneously increase the resistance of the rotational biasing element 32, either by a same or different degree. Alternatively, increasing the resistance of the translational biasing element 30 may simultaneously decrease the resistance of the rotational biasing element 32, and/or vice versa.

In one embodiment of the invention, the biasing elements 30 and 32 are springs, and the resistance of the biasing elements may be adjusted by removing a specific spring and replacing it with a spring having a different spring strength. Alternatively, or in addition, the resistance of biasing elements 30 and 32 may be simultaneously or independently adjusted by manipulating one or more screws, dials, sliders, or similar controls on the exterior of housing 14, such as by changing the compression of the springs.

Any means of detecting one or both of the longitudinal translational movement and rotational movement of the blade tang 28 is a suitable one for the purposes of this invention, provided that the longitudinal and rotational movements can be distinguished and independently detected. As shown in FIGS. 2-5, training aid 16 includes a first and a second sensor in the forms of switch 44 and switch 46.

Switch 44 corresponds to a longitudinal translation sensor, and is placed within housing 14 in such a manner that an inward longitudinal translation of blade tang 28 of sufficient magnitude will trigger switch 44, and thereby signal that a substantial contact has been made with the blade tip 24. In one embodiment of the invention, the translation distance required for triggering switch 44 may be adjusted by the user, for example by increasing or decreasing the distance between the blade tang 28 and the trigger of switch 44, for example by adjusting a set screw that sets the limit for the distance that blade 18 is extended outwardly by the urging of translational biasing 30. As shown, the inward translation of the blade 18 results in the closing of switch 44, with concomitant detection of the blade translation. However, the particular sensor used for detecting translational movement may alternatively employ a switch that opens, rather than closes, when triggered.

Similarly, switch 46 corresponds to a rotational sensor, and is placed within housing 14 in such a manner that a rotation of blade tang 28 around pivot point 31 having a sufficient magnitude will trigger switch 46, thereby signaling a substantial contact has been made with the blade edge 26. In one embodiment of the invention, the degree of rotation required for triggering switch 46 may be adjusted by the user, for example by increasing or decreasing the distance between the blade tang 28 and the trigger of switch 46. As shown for the exemplary training aid 16, the clockwise rotation of blade 18 around pivot point 31 results in the opening of switch 46, with concomitant detection of the blade rotation. However, the particular sensor for detecting rotational movement may alternatively employ a switch that closes, rather than opens, when triggered.

Blade 18 includes a pivot pin 48, which in turn engages housing 14. More specifically, pivot pin 48 extends into an elongate aperture 50 on each half of housing 14, as shown in FIG. 3. The dimensions of elongate aperture 50 are generally selected so that blade 18 can pivot smoothly around pivot pin 48 without undesirable translational movement along an axis other than the longitudinal axis of housing 14. Put another way, substantial contact with blade edge 26 should result in the pivoting of blade 18, but should not result in any significant translation of blade tang 28 in a direction that is at an angle to the longitudinal axis of housing 14.

On the other hand, by virtue of having an elongate shape, pivot pin 48 is able to move within aperture 50 in the direction of the longitudinal axis of the housing, thereby permitting a substantial contact with blade tip 24 to be detected by an inward movement of blade 18.

Also enclosed within housing 14 is a processor 52 that is configured to detect and optionally differentiate between the activation of longitudinal translation sensor 44 and rotation sensor 46. In FIGS. 2-5, processor 52 is represented by a printed circuit board 54 that includes a chipset 56. Chipset 56 may include one or more chips configured to detect the triggering of switches 44 and 46, and correlate such triggering with a substantial contact at blade tip 24 and blade edge 26, respectively. In one embodiment of the invention, processor 52 additionally activates one or more indicating elements to reflect the detected contacts and contact locations.

Processor 52 of training aid 16 is electronically coupled to switches 44 and 46 by wiring 58 and 60, respectively, and further coupled to an indicating element 62 by wiring 64. The indicating element employed by the training aids of the present invention may display a light, generate a sound, activate a display, or generate a wireless signal, among other indicating means.

Where the indicating element includes a light, the light may be a single light source, or multiple light sources. A blade tip contact may be differentiated from a blade edge contact for example by generating light having different colors, or by flashing the light source a selected number of times. The light source may include an incandescent bulb, an LED, an electroluminescent element, or other light source.

Where the indicating element generates a sound, the indicating element is an audible indicator, and successful contacts with blade 18 may result in the generation of a single audible tone, multiple distinct tones, or multiple distinct tone patterns that may correspond to one of a blade tip contact or a blade edge contact.

Where the indicating element generates a wireless signal, the indicating element may include an RF signal generator or IR signal generator, among other wireless signal generators. In this embodiment, the indicating element further includes a wireless receiver configured to detect the generated wireless signal and indicate a blade contact has been made, and/or differentially indicate the type of blade contact made.

Alternatively, or in addition, processor 52 may be coupled to a display, such as a digital display, that may track and/or display the number and type of contacts made with the blade. Any such indicating methods may be used in combination, such as having both a visual and audible indicator of contact.

In the case of training aid 16, indicating element 62 includes a light disposed in a channel 66, where the configuration of the channel helps amplify the light signals produced by indicating element 62 to make such signals more visible. Preferably, the indicating element is sufficiently noticeable that a third party, such as a judge, referee, or instructor, can easily observe the activation of the indicating element.

The training aid of the invention may include one or more controls on the housing, permitting a user to perform any desired operation of the training aid. Selected controls may reset a counter that is recording the number of successful contacts detected, change the value being shown on a display, clear a memory, alter the specifics of the indicating mechanism (for example audible and/or visible), or change the color of the indicating mechanism to assist in identifying members of respective teams (e.g., a blue team and a red team), among other possibilities. As shown in FIGS. 1-5, training aid 16 includes representative controls 68 and 70, which are coupled to processor 52 by wiring 68 and 70, respectively.

The training aids of the present invention typically will include a power supply that is configured to provide power to the one or more sensors, the processor, and the one or more indicating elements, at least. The power supply will generally be sized to fit within housing 14, and in the case of exemplary training aid 16, the power supply is a battery 76, such as a disc battery. However any of a wide variety of batteries and power cells may be similarly employed.

Figure 4:
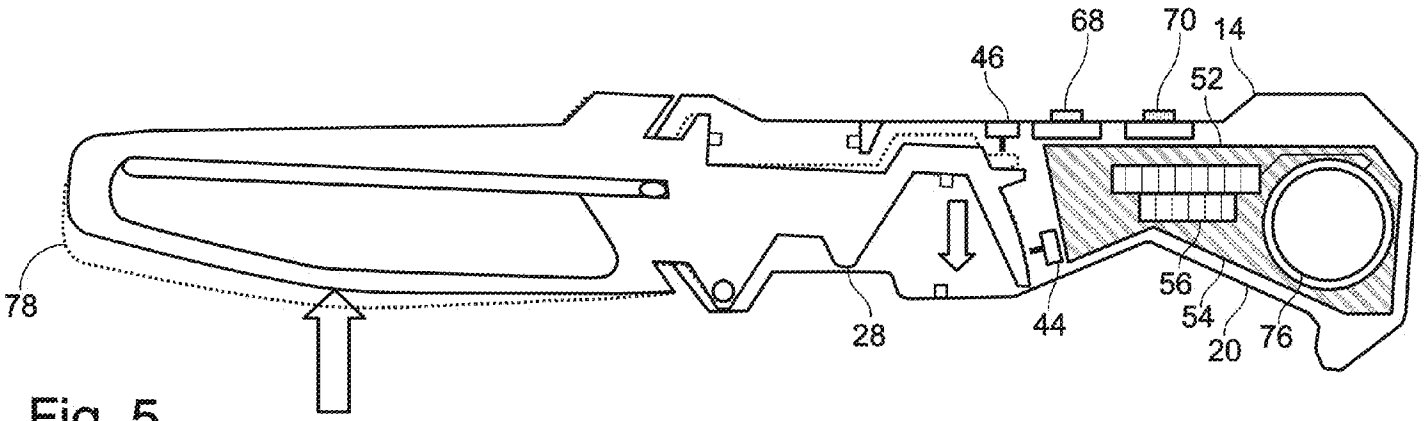
FIG. 4 is a side elevation view of the training aid of FIG. 2 showing the result of contact with the edge of the contact member.
Figure 5:
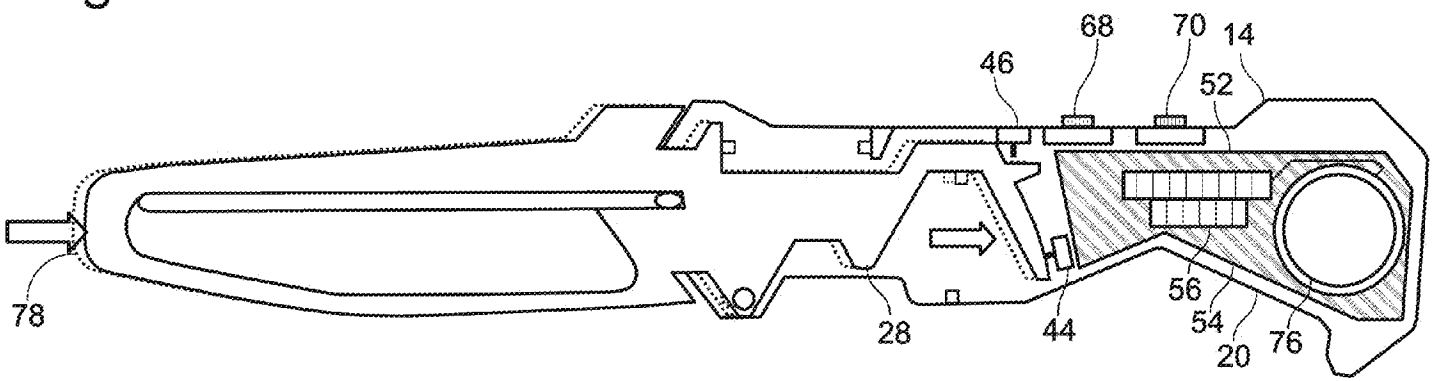
FIG. 5 is a side elevation view of the training aid of FIG. 2 showing the result of contact with the tip of the contact member.
Figure 6:
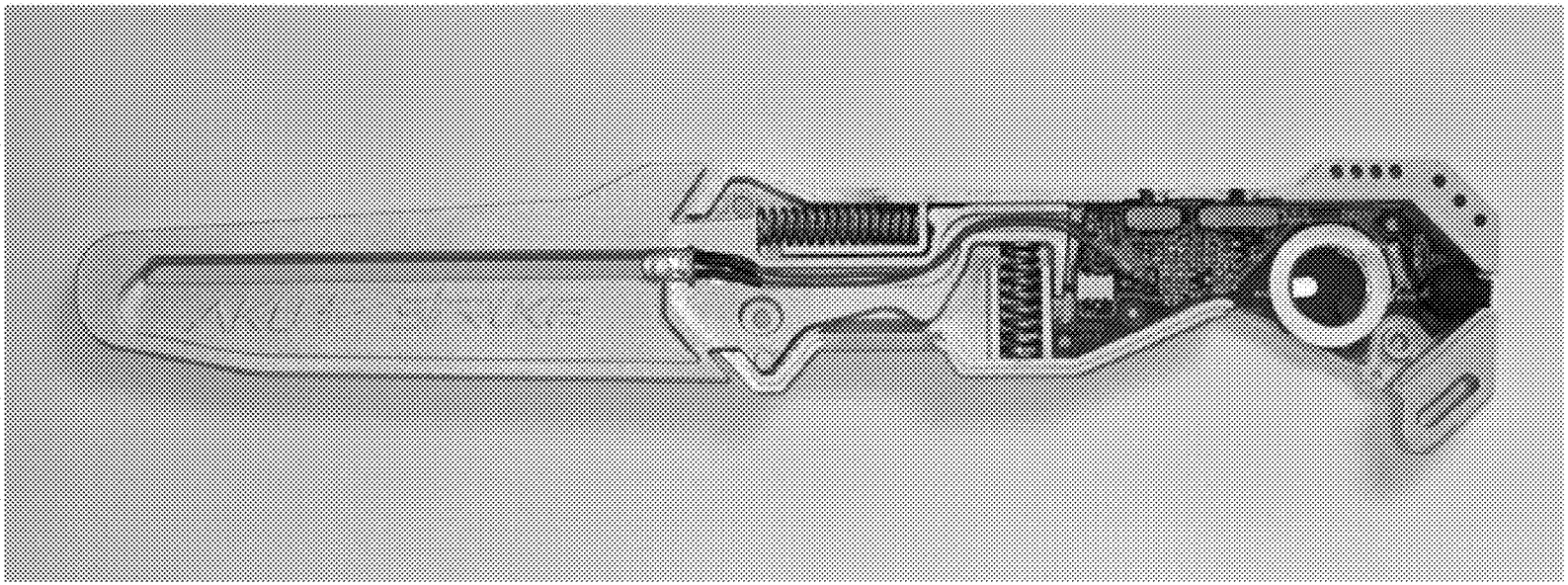
FIG. 6 is a cutaway side elevation view of a training aid according to another exemplary embodiment of the invention.
Figure 7:
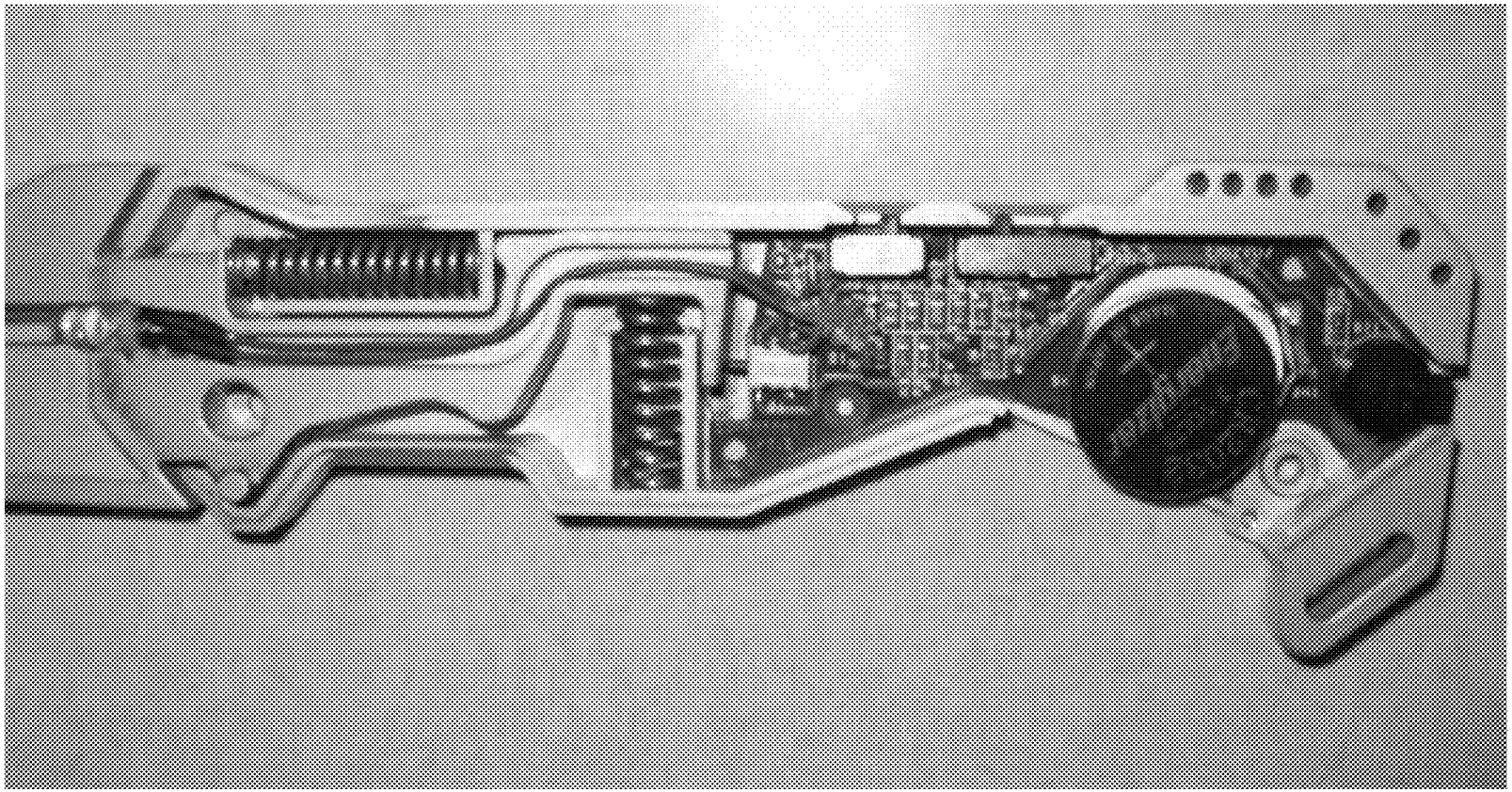
FIG. 7 is a view of the interior of the housing of the training aid of FIG. 6.
Figure 8:
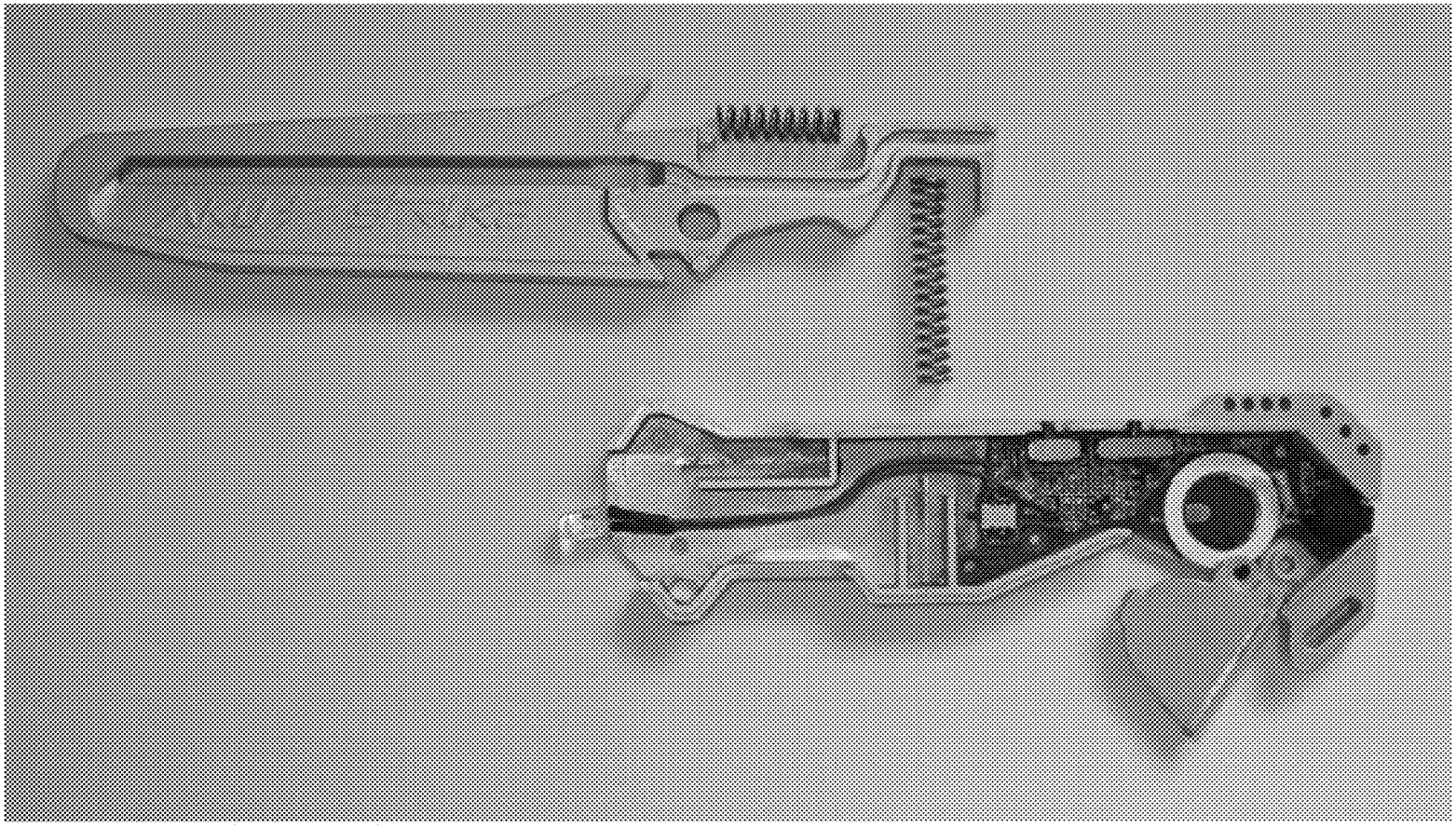
FIG. 8 is an exploded view of the training aid of FIG. 6.
Figure 9:
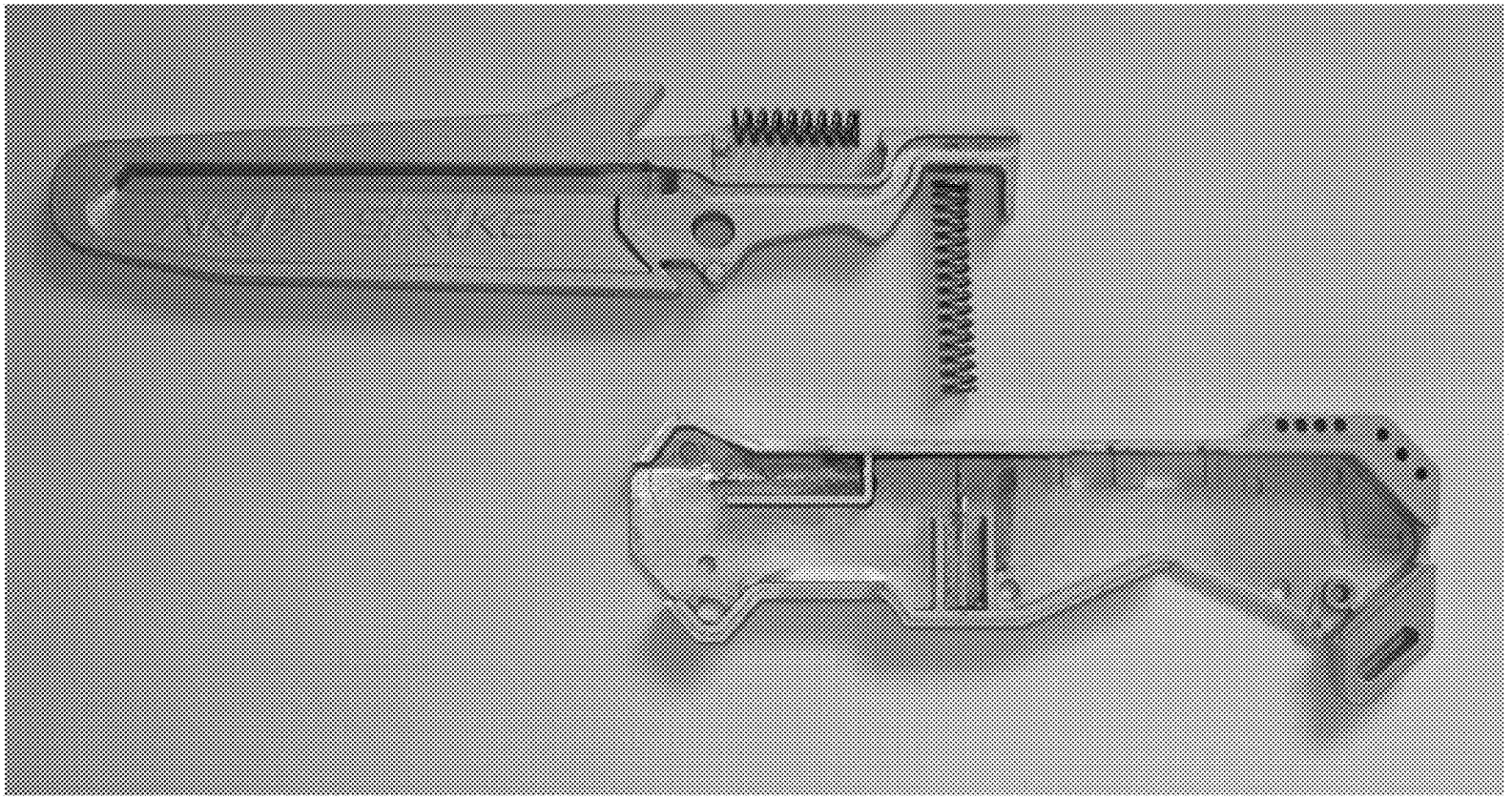
FIG. 9 is an exploded view of the training aid of FIG. 6 showing the contact member, the biasing members, and half of the housing of the training aid of FIG. 6.
Figure 10:
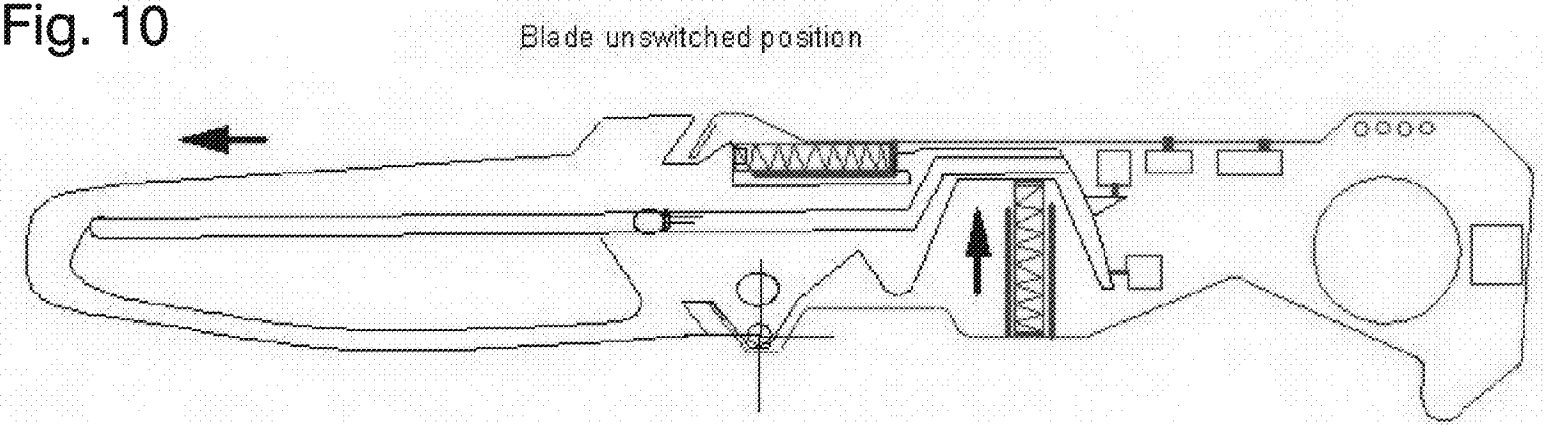
FIG. 10 is a schematic side elevation view of a training aid according to yet another exemplary embodiment of the invention.
Figure 11:
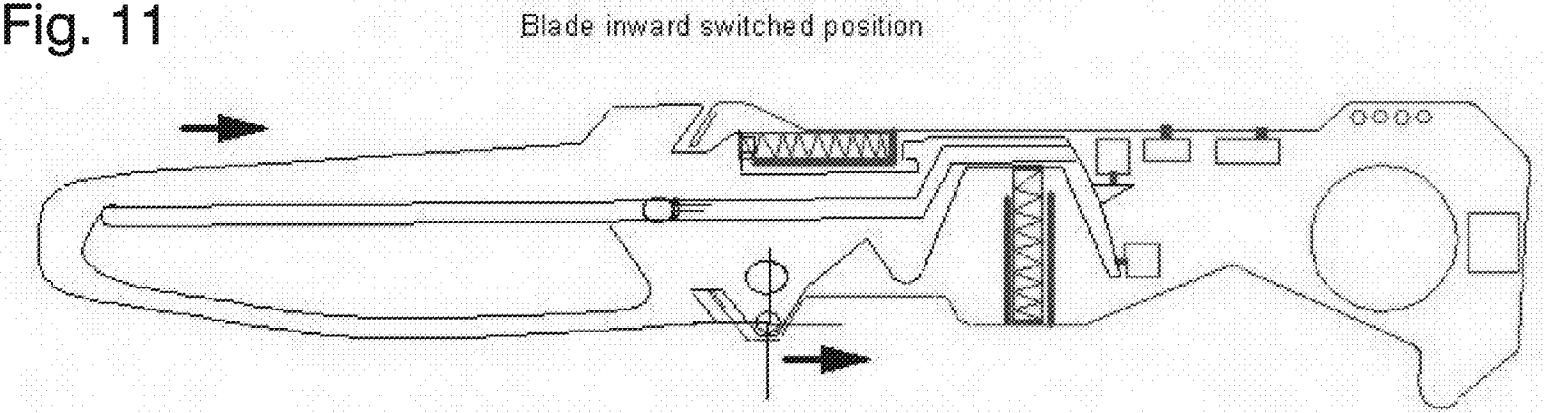
FIG. 11 is a schematic side elevation view of the training aid of FIG. 10, showing longitudinal translation of the contact member.
Figure 12:
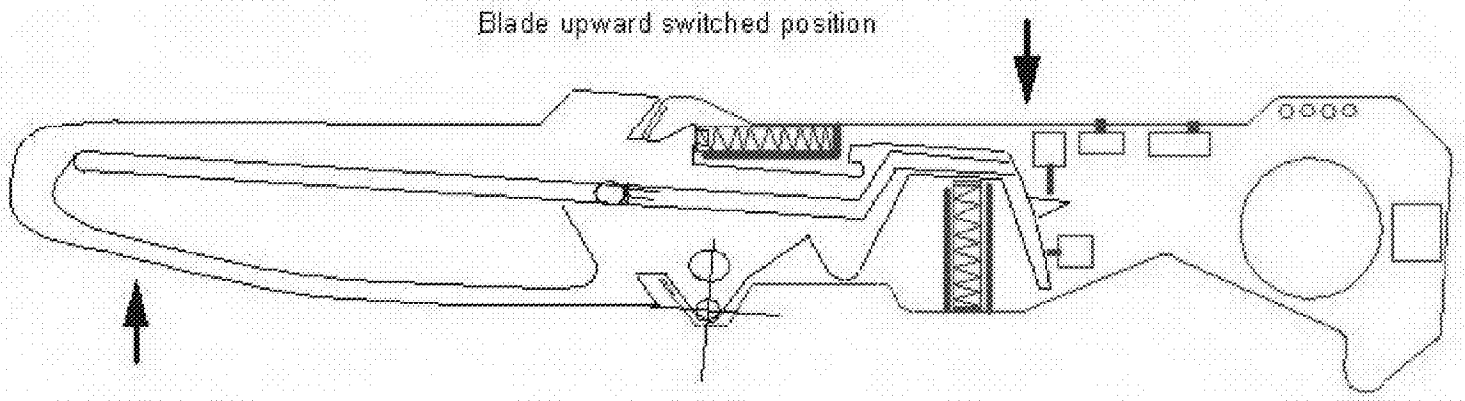
FIG. 12 is a schematic side elevation view of the training aid of FIG. 10, showing rotation of the contact member.
Figure 13:
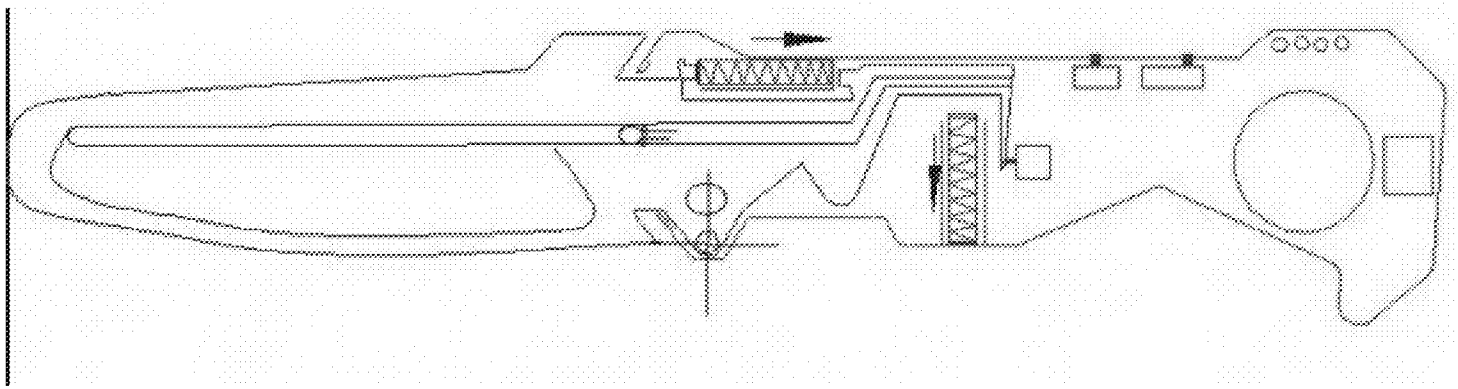
FIG. 13 is a schematic side elevation view of a training aid according to yet another exemplary embodiment of the invention.
Figure 14:
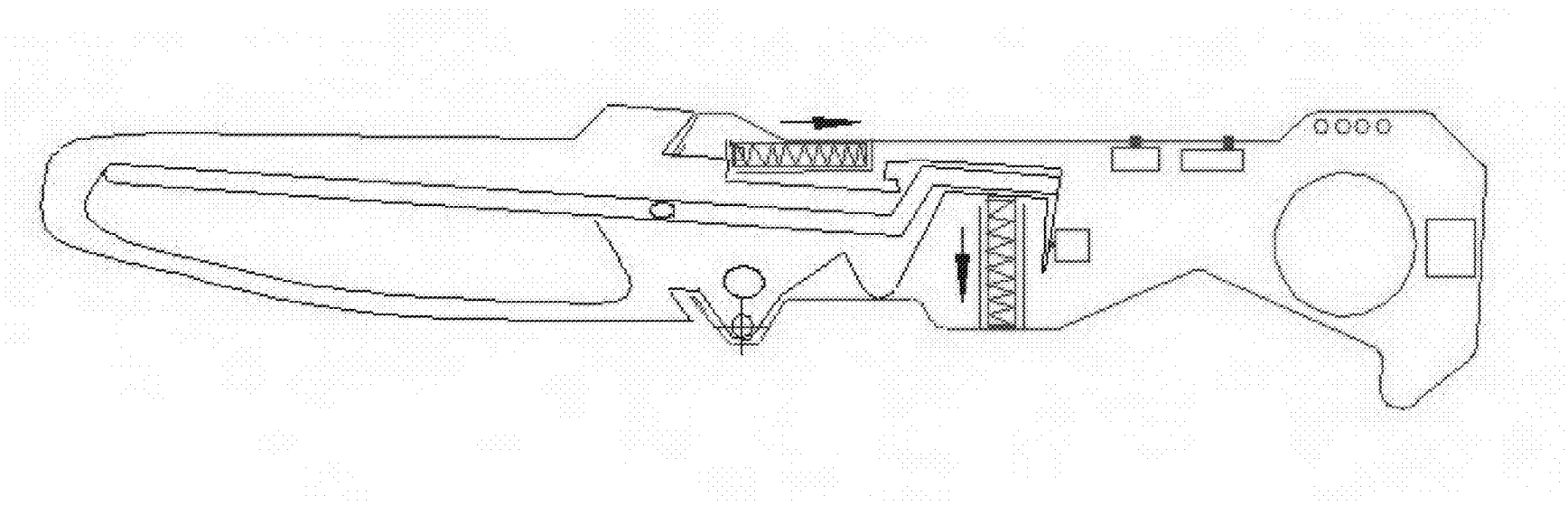
FIG. 14 is a schematic side elevation view of the training aid of FIG. 13 showing rotation of the contact member.

The operation of training aid 16 is shown in greater detail in FIGS. 4 and 5. The biasing elements and wiring of training aid 16 are omitted in FIGS. 4 and 5 for the sake of clarity. The dashed outline 78 represents the neutral position of blade 18, in the absence of any applied forces other than that caused by the biasing elements 30 and 32. FIG. 4 depicts a substantial contact with blade edge 26 of blade 18, as indicated by the upwardly directed arrow. As blade 18 pivots around pivot pin 48, blade tang 28 is rotated downwardly. As a result, contact with switch 46 is lost, and the blade rotation is then detected by processor 52, and a blade edge contact is signaled by indicating element 62.

Similarly, dashed outline 78 of FIG. 5 represents the neutral position of blade 18 before a substantial contact with the tip 24 of blade 18. After a substantial contact with blade tip 24, blade 18 undergoes an inward translation, as indicated by the rightwardly directed arrow. As a result, the blade tang 28 connects with switch 44, and the blade translation is then detected by processor 52, and a blade tip contact is signaled by indicating element 62.

The contact-indicating devices of the present invention may be particularly useful for performing a method of indicating contact with a target, where the method includes providing a contact-indicating device according to the present disclosure, effecting a contact with the target with the contacting member, where the effected contact is sufficiently substantial to cause either a translation of the contact member or a pivoting of the contacting member, or both, thereby triggering the corresponding translation sensor, rotation sensor, or both, where the contact-indicating apparatus used is configured to differentiate between the triggering of the translation sensor and the triggering of the rotation sensor, and to provide an indication of which sensor was triggered.

Where the contact-indicating devices of the present invention are configured to resemble a bladed weapon, they are additionally useful for performing a method of tactical training, the method including providing a tactical training aid according to the present disclosure, effecting contact with a target using the blade of the tactical training aid, where the contact is sufficient to activate the longitudinal translation sensor, activate the rotation sensor, or both, observing an indication of substantial contact by the tactical training aid, and identifying whether the effected contact occurred with the blade tip, the blade edge, or both.

The tactical training method may further include scoring each effected contact based on the identified contact location, that is, whether the contact was made with a blade tip, or a blade edge.

For some applications, the contact-indicating device may be more preferably used when configured to indicate either of a blade tip contact or blade edge contact with a single indication. That is, where the user is only interested in identifying substantial contacts, regardless of contact type, or when being trained in the use of a weapon that employs only one of tip contact or blade contact (e.g., the Indonesian karambit, among others). In such applications it may be advantageous for the contact-indicating device to indicate when a substantial contact has been made regardless of the type of contact. That is, regardless of whether a contact triggers the translation sensor, the rotation sensor, or both, the indication generated by the indicating element would be the same.

In one embodiment, the contact-indicating device may be operable in one or more of multiple detection modes. For example, the contact-indicating device may include a detection mode where only tip contacts are registered, while blade edge contact detection is disabled. In yet another detection mode, only edge contacts may be registered, while blade tip contact detection is disabled. In yet another alternative detection mode, both tip contacts and edge contacts may be indicated equivalently. In yet another alternative detection mode, blade tip contacts and blade edge contacts are differentiated and the indicating element distinguishes between the two types of contacts.

The presently disclosed contact-indicating devices represent a relatively inexpensive means of scoring in a training setting, or in the context of competitive gameplay, without the need of conductive outerware or intrusive cables that interfere with freedom of movement.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

Although selected embodiments of the representative contact-indicating devices are disclosed herein, it will be apparent to those skilled in the art that various changes in form and detail may be made without departing from the spirit and scope of the invention. The present invention is intended to embrace all such alternatives, modifications and variances that fall within the scope of the appended claims.

What is claimed is:

1. A contact-indicating device, comprising:

an elongate contacting member;

a housing configured to enclose a portion of the contacting member, the housing further enclosing a translation sensor configured to detect an inward longitudinal translation of the contacting member, and a rotation sensor configured to detect a pivoting of the contacting member in a first direction; and at least one indicating element, wherein:

the indicating element is configured to indicate at least one of the detected longitudinal translation of the contacting member and the detected pivoting of the contacting member in the first direction;

the indicating element is configured to differentiate between the detected longitudinal translation of the contacting member and the detected pivoting of the contacting member in the first direction; and the housing is configured to function as a handle for the device, and the portion of the contacting member extending beyond the housing is configured to resemble a blade having a blade tip and a blade edge.

2. The contact-indicating device of claim 1, wherein the inward longitudinal translation of the contact member is a result of a substantial contact with the blade tip.

3. The contact-indicating device of claim 1, wherein the pivoting of the contacting member in a first direction relative to a pivot point defined by the pivoting of the contacting member is a result of a substantial contact with the blade edge.

4. The contact-indicating device of claim 1, further comprising a translational biasing element that urges the contacting member longitudinally outward from the housing; and a rotational biasing element that urges the contacting member pivotally in a second direction that is contrary to the first direction.

5. The contact-indicating device of claim 4, wherein a bias strength of the translational biasing element and a bias strength of the rotational biasing element are independently adjustable.

6. The contact-indicating device of claim 1, wherein a magnitude of the minimum detectable longitudinal translation and a magnitude of the minimum detectable pivoting needed for detection are independently adjustable.

7. The contact-indicating device of claim 1, wherein the housing further encloses a processor configured to activate an indicating element upon detection of longitudinal translation or rotation of the contacting member.

8. A tactical training aid, comprising:

a blade having a tip, an edge, and a tang;

a housing enclosing the tang and thereby forming a blade handle;

a sensor configured to detect a longitudinal translation of the tang caused by a substantial contact with the blade tip;

a sensor configured to detect a rotation of the tang with respect to a pivot point for the blade within the housing, where the rotation is caused by a substantial contact with the blade edge;

wherein the tactical training aid is configured to indicate the detection of substantial contact with the blade tip, and the detection of substantial contact with the blade edge.

9. The tactical training aid of claim 8, wherein the tactical training aid is configured to differentiably indicate the detection of substantial contact with the blade tip and the detection of substantial contact with the blade edge.

10. The tactical training aid of claim 8, further comprising a longitudinal biasing element that urges the blade longitudinally outward from the housing; and a rotational biasing element that urges the blade pivotally in a direction that is toward the blade edge.

11. The tactical training aid of claim 10, wherein the bias strength of the longitudinal biasing element and the bias strength of the rotational biasing element are independently adjustable.

12. The tactical training aid of claim 8, wherein at least one of a magnitude of a minimum detectable longitudinal translation and a magnitude of a minimum detectable pivoting are independently adjustable.

13. The tactical training aid of claim 8, wherein the blade handle further encloses a processor configured to detect at least one of the longitudinal translation or rotation of the blade, and to activate an indicating element to indicate the detection of the at least one of the longitudinal translation or rotation of the blade.

14. The tactical training aide of claim 13, wherein the indicating element is configured to produce one or more of a visible signal and an audible signal to indicate the detection of the at least one of the longitudinal translation or rotation of the blade.

15. The tactical training aid of claim 13, wherein the blade handle further encloses a power supply configured to provide power to one or more sensors, to the processor, and to one or more indicating elements.

16. The tactical training aide of claim 8, further comprising a recording element configured to independently record a number of detected longitudinal translations and detected rotations.

17. A method of indicating contact with a target, comprising:

providing a contact-indicating device, the contact-indicating device including an elongate contacting member;

a housing configured to enclose a portion of the contacting member, the housing further enclosing a translation sensor configured to detect an inward longitudinal translation of the contacting member, and a rotation sensor configured to detect a pivoting of the contacting member in a first direction; and at least one indicating element, wherein the indicating element is configured to indicate at least one of the detected longitudinal translation of the contacting member and the detected pivoting of the contacting member in the first direction; and effecting a contact with the target with the contacting member, where the effected contact is sufficiently substantial to cause either a detectable translation of the contact member or a detectable pivoting of the contacting member, or both, thereby triggering the corresponding translation sensor, rotation sensor, or both;

detecting the detectable translation of the contact member or the detectable pivoting of the contacting member, or both; and indicating, by the indicating element, the detection of the detectable translation of the contact member or the detectable pivoting of the contacting member, or both.

18. A method of tactical training, comprising:

providing a tactical training aid, the tactical training aid including a blade having a tip, an edge, and a tang;

a housing enclosing the tang and thereby forming a blade handle;

a sensor configured to detect a longitudinal translation of the tang caused by a substantial contact with the blade tip;

a sensor configured to detect a rotation of the tang with respect to a pivot point for the blade within the housing, where the rotation is caused by a substantial contact with the blade edge;

wherein the tactical training aid is configured to differentiably indicate the detection of substantial contact with the blade tip, and the detection of substantial contact with the blade edge;

effecting contact with a target using the blade of the tactical training aid, where the contact is sufficient to activate the longitudinal translation sensor, activate the rotation sensor, or both;

observing an indication of substantial contact by the tactical training aid; and identifying whether the effected contact occurred with the blade tip, the blade edge, or both.

19. The method of claim 18, further comprising scoring the effected contact based on the identified contact location.

20. A contact-indicating device, comprising:

an elongate contacting member;

a housing configured to enclose a portion of the contacting member, the housing further enclosing a translation sensor configured to detect an inward longitudinal translation of the contacting member, and a rotation sensor configured to detect a pivoting of the contacting member in a first direction;

at least one indicating element;

a translational biasing element that urges the contacting member longitudinally outward from the housing; and a rotational biasing element that urges the contacting member pivotally in a second direction that is contrary to the first direction;

wherein:

the indicating element is configured to indicate at least one of the detected longitudinal translation of the contacting member and the detected pivoting of the contacting member in the first direction.

21. The contact-indicating device of claim 20, wherein a bias strength of the translational biasing element and a bias strength of the rotational biasing element are independently adjustable.

22. The contact-indicating device of claim 20, wherein the indicating element is configured to differentiate between the detected longitudinal translation of the contacting member and the detected pivoting of the contacting member in the first direction.

23. The contact-indicating device of claim 20, wherein the housing is configured to function as a handle for the device, and the portion of the contacting member extending beyond the housing is configured to resemble a blade having a blade tip and a blade edge.

24. The contact-indicating device of claim 23, wherein the inward longitudinal translation of the contact member is a result of a substantial contact with the blade tip.

25. The contact-indicating device of claim 23, wherein the pivoting of the contacting member in a first direction relative to a pivot point defined by the pivoting of the contacting member is a result of a substantial contact with the blade edge.

* * * * *